United States Patent [19]

Weller et al.

[11] 4,140,627

[45] Feb. 20, 1979

[54] MAILING SORTER HAVING PARALLEL DELIVERY CONVEYORS AND PARALLEL SORTING CONVEYORS WITH CHAIN-SPEED MAIL SEPARATION

[75] Inventors: Ronald W. Weller, Oak Lawn; John Vente, Western Springs, both of Ill.

[73] Assignee: McCain Manufacturing Corporation, Chicago, Ill.

[21] Appl. No.: 805,724

[22] Filed: Jun. 13, 1977

[51] Int. Cl.[2] ..... B07C 5/02; B07C 5/344

[52] U.S. Cl. ..... 209/3.3; 209/584; 198/460

[58] Field of Search ..... 209/73, 74 R, 74 M, 209/111.7 R, 111.8, DIG. 1; 198/460, 425

[56] References Cited

U.S. PATENT DOCUMENTS

| | | | |
|---|---|---|---|
| 3,145,828 | 8/1964 | Hawley | 198/425 X |
| 3,363,739 | 1/1968 | Mebus | 198/425 |
| 3,520,404 | 7/1970 | Pine | 209/72 |
| 3,652,828 | 3/1972 | Sather | 209/80.5 |
| 3,870,139 | 3/1975 | Wagner | 198/425 X |
| 4,014,784 | 3/1977 | Dunlap | 209/73 |

*Primary Examiner*—Allen N. Knowles

*Attorney, Agent, or Firm*—Kinzer, Plyer, Dorn & McEachran

[57] ABSTRACT

Mail is sorted by scanning zip code data, delivering the scanned mail from a delivery conveyor to a sorting conveyor and altering the speed of the sorting conveyor when there is a change in the zip code; zip code batches cannot be interrupted by missing pieces. The delivery conveyor and sorting conveyor are at right angles and both conveyors may be duplicated by a parallel conveyor, enabling large size mail to be handled.

4 Claims, 3 Drawing Figures

20
18
89
84
12B
82
44
92
42
10B
88
86
64
66
68
70
71
76
74
72
26
22
28
24
12
14
-34-
-38-
-32-
-36-
10
46
47
62
1

MAILING SORTER HAVING PARALLEL DELIVERY CONVEYORS AND PARALLEL SORTING CONVEYORS WITH CHAIN-SPEED MAIL SEPARATION

This invention relates to a sorter which is particularly applicable to arranging books in the order of zip code addresses, or some other order, where a change in order is represented by an obvious gap in an otherwise constant delivery.

In the graphic arts a book is a collection of signatures; a signature is a folded sheet. The books here involved may vary considerably in size both in terms of the number of pages, in the head to foot dimensions and in the back to front dimensions.

It is known practice to sort books by stacking them on a moveable conveyor which is held stationary while the stack is formed, afterwards actuating the conveyor to move the stack forwardly incidental to starting a new stack. This has been proposed for sorting by zip codes. Considerable difficulties in programming a machine control are encountered, however, due to Post Office regulations regarding the minimum zip code quantity for a mail bag and due to the plain fact one can only stack so high.

In some instances, a stack no higher than a predetermined number (say twenty) can be handled without toppling; even then, the stack may lean quite a bit because the back of the book is usually thicker than the front.

The Post Office bureaucrats at times announce arbitrary standards for the least number of books in one mail bag under one zip code number. Assume six as the least number, assume one hundred and five total for the zip code involved and assume no more than twenty can be safely stacked. This means the machine has to be programmed to stack this way: 20-20-20-20-19-6. Stacking 21-21-21-21-21 is unacceptable because a stack of twenty-one is deemed too high, nor is 20-20-20-20-20-5 acceptable because of the bureaucrats. For any stack less than six (under the example) these must be bagged separately which means the machine must be equipped with some sort of diverter to separate automatically from the main stream any series of books which has less than six assigned to any one zip code.

Of course with enough time and experience a person ought to be able to recognize (or count) that the stack has less than six books, making a diverter unnecessary. However, stacks of one or two are not infrequent, which means the machine has to be stopped for one or two cycles and then re-started. If speed is a premium this is hard to do without toppling the higher stacks. On the other hand if the stacker conveyor is slowed down then the delivery thereto must be slowed down. The compromise is simply to make provision to divert from the main stream any number less than the minimum the Post Office will accept.

The foregoing should not be considered the only illustration of the shortcomings of counting and stacking in order to sort; the illustration is simply chosen as one easily imagined where there are indeed two limiting factors, namely, a stack too high and a stack of too few. The factor could be weight of a stack. There are other shortcomings to sorting by counting and stacking: books in a stack are awkward to handle, especially where the stack leans as is invariably the case; if the books are labelled for mailing, one can't always determine easily if all the labels are on and on properly; the machine program must provide for the count.

In accordance with the present invention, and as the primary object thereof, books are sorted without regard to stacking; rather the sorting conveyor is driven normally at a constant slow speed, the pieces of mail being delivered thereto one by one in shingled array, and when there is a change in order or classification (e.g. change from one zip code to another or when a preset batch count is reached, say 20) the collecting conveyor is accelerated so there will be an obvious gap for sorting between the trailing end of one batch or one zip code and the leading end of the following group. A related object of the invention is to drive the sorting conveyor through a clutch which will be disabled in the event there is failure to make delivery to the sorting conveyor in the first instance, thereby to avoid creating a false sort gap.

Another object of the invention is to embody the sorting conveyor as a pair of parallel conveyors arranged at right angles to a pair of delivery conveyors where the labeled mail can be visually scanned for zip code change and sensed for compliance to a continuous stream sequence in two parallel streams. By this arrangement, the books can be advantageously shingled as they are delivered to the sorting conveyor. A related object of the invention is to equip each delivery conveyor, at the end proximate the sorting conveyors, with a leaf or extension. If both extensions are present, the far one of the sorting conveyors can be used, whilst if one is removed there can be delivery to both sorting conveyors.

IN THE DRAWING

GENERAL DESCRIPTION AND ARRANGEMENT OF THE DELIVERY CONVEYOR AND SORTING CONVEYOR

Figures 2, 3:
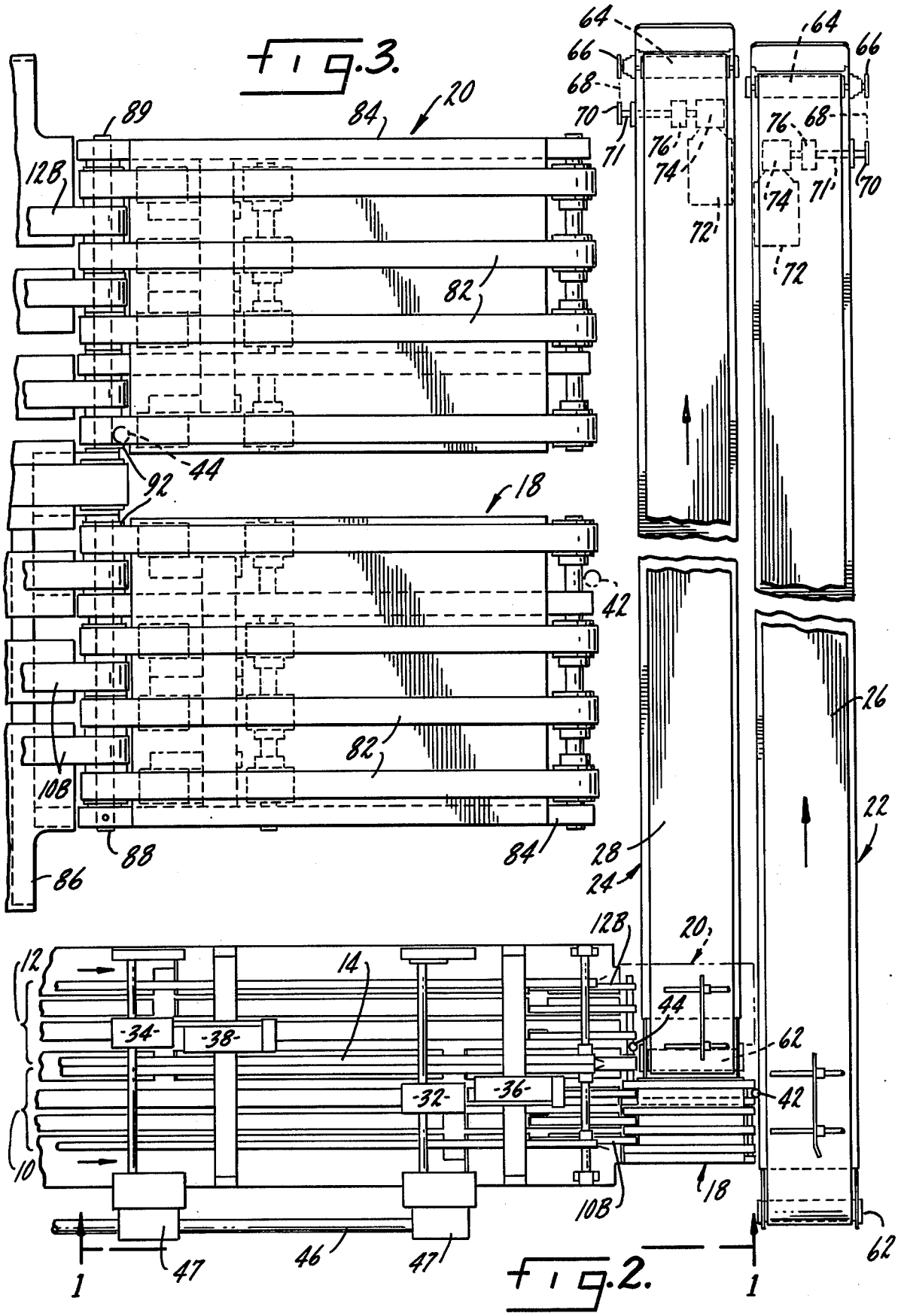
FIG. 2 is a fragmentary plan view of a machine constructed in accordance with the present invention.
FIG. 3 is an enlarged plan view of a portion of the machine shown in FIG. 1.

The books to be sorted may be fed in the direction of the arrows, FIG. 2, by two parallel delivery conveyors 10 and 12 which are separated by a removable divider plate 14.

Each delivery conveyor may terminate at a plurality of endless feed belts as 10B and 12B, in turn terminating at respective pairs of extendible conveyor leaves 18 and 20 which may be selectively activated as will be explained.

Also, there are two parallel sorting conveyors 22 and 24 represented by individual wide belts 26 and 28 of endless form and these are arranged at right angles to the delivery conveyors.

If either leaf 18 or 20 is extended, it delivers the books to sorting conveyor 22; if leaf 20 is omitted, its associated delivery conveyor 12 will feed sorter 24.

The delivery conveyors operate at a constant speed but the sorting conveyors each have a variable speed for reasons to be explained.

SPECIFIC CONSTRUCTION

The delivery feed belts move the books toward the sorting conveyors and in doing so the books, moving along either path 10 or 12 as the case may be, move past and beneath respective label applying heads 32 and 34 where individual mail labels are applied thereto at an assigned location. Ordinarily, only one delivery conveyor and one sorting conveyor will be used, but clearly the other or dual stream capability is available.

It is appropriate to mention that for books being processed in a single stream, they will be fed along only one path 10 or 12, not both, and hence only one of the sorting conveyors will be active as already noted. If the books are quite large, the divider 14 will be removed so that the mail will be fed down the center and in that event both leaves 18 and 20 will be extended to deliver the single stream of mail to sorting conveyor 22; conveyor 24 will be definitely de-activated under this circumstance.

Figure 1:
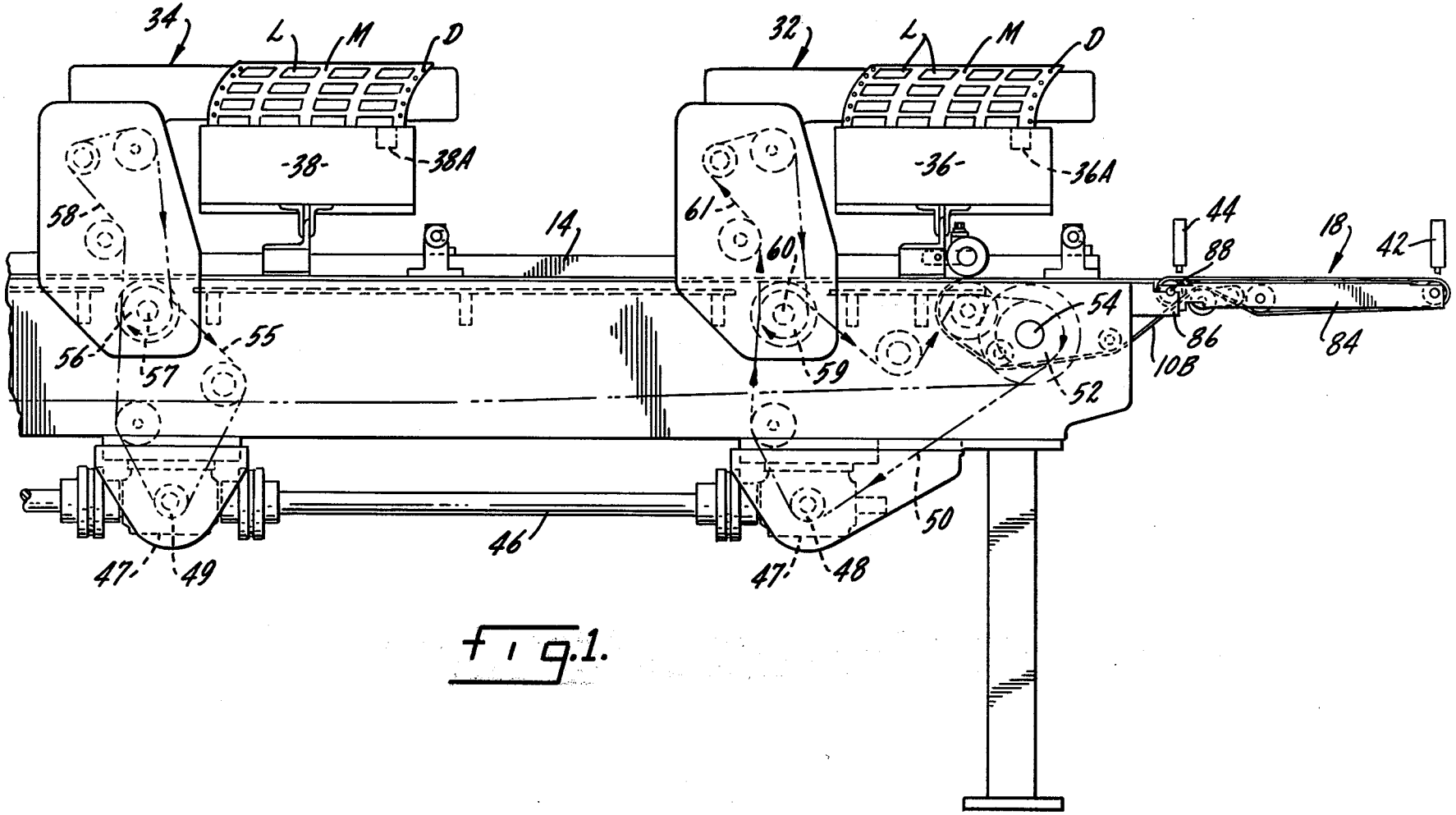
FIG. 1 is a fragmentary side elevation of a machine constructed in accordance with the present invention, taken on the line 1—1 of FIG. 2, on an enlarged scale compared to FIG. 2.

Each label applying head is fed from a respective supply hopper, 36 and 38 where the labels L, FIG. 1, are separated from manifolds M. The manifolds have computer print-out zip code data D along one margin. These data are scanned or sensed at the supply hoppers by respective scanner heads 36A and 38A; information regarding a change in zip code is stored until it is to be used in a manner to be explained. The storage device may be a shift register, stepped in accordance with the machine cycles, as in McCain U.S. Pat. No. 3,275,210.

Also, scanning and delayed storage of the zip code data, until the information is to be used, may be in accordance with the disclosure of U.S. Pat. No. 3,507,211 but any suitable system may be employed.

Sensor means are provided in the form of photocells 42 and 44 so positioned near the end of each delivery conveyor as to scan for the presence of a book moving beneath. The photocells 42 and 44 are for the dual stream of books, and are positioned at the end of each leaf 18 and 20 adjacent the respective sorting conveyor; in the other circumstance, where both flights 10 and 12 are employed to deliver large pieces of mail, one photocell, 42, may be positioned and used for the same purpose.

Each such photocell, on passage of a book therebeneath, will generate a signal to a preset batch counter, or in the event of failure to detect a book, a different signal is generated to interrupt the drive for the related conveyor for one book cycle. If the missing book were to go undetected this would produce a false gap on the sorting belt.

The feed belts of the delivery conveyors are driven at a constant, invariant speed. The source of this drive is a drive shaft 46, FIG. 1, which, through suitable gearing inside gear reducing boxes as 47, drives sprockets 48 and 49. Sprocket 48 has a chain 50 which drives a sprocket 52. The sprocket 52 in turn drives a shaft 54 which may be used to drive pulleys which carry the feed belts as 10B and 12B; other intermediate drives may be employed in an instance where the delivery feed belts instead of being continuous from one end of the delivery conveyor to the other, are discontinuous but in tandem relation so that the books to be labeled and delivered are passed along in any event.

Sprocket 48 thru chain 50 also drives a sprocket 59 on shaft 60 which drives chain 61 used to drive the parts associated with the label applying head 32.

Sprocket 49 drives a chain 55 which in turn drives a sprocket 56 on a drive shaft 57 used to drive another chain 58 which drives the parts associated with the label applying head 34.

The timing is such that in one cycle of the machine a book to be labeled is fed past its label applying head which applies the label in that same cycle. During successive cycles that same book is ultimately delivered to the related sorting conveyor belt 26 or 28. Because of the successive cycles, following labeling, it is necessary to store the zip code data scanned at the scanning head. It will be recognized, for example, from FIG. 2, that more cycles of the machine are required to feed a book from the labeling head 34 to its sorter 24 (say nine cycles) than are required to feed a book from labeling head 32 to its sorter 22, say only six cycles.

The belts of the sorting conveyor are supported at one end by idler rollers as 62 and at the opposite end are played about driver rollers 64; intemediate support and tensioning rollers may be used.

The driver rollers 64, FIG. 2, have sprockets as 66 driven by a related chain 68 carried by a drive sprocket 70 supported on a drive shaft 71. This arrangement is the same for each sorting conveyor as will be apparent in FIG. 2.

There is an independent variable speed motor 72, gear reducer 74 and clutch 76 for each drive shaft 71.

The variable speed motor may be of any preferred form. We prefer a so-called SCR variable speed motor which is a very efficient DC motor in which speed variation is achieved by varying the applied voltage through a silicon controlled rectifier. It is only necessary that there be two speeds, fast and slow, for reasons to be explained.

The clutches are also electronically controlled and will be instantly disengaged in the event a photocell originates a signal indicative of no book.

The extensions or leaves associated with the delivery conveyors enable an advantageous right angle relationship be achieved as will be evident in FIG. 2. This conserves space, enables an attendant more easily to supervise the equipment while gathering the mail and also enables the leaves 18 and 20 to be advantageously employed. A typical operating arrangement is shown in FIG. 2 where leaf 20 has been detached so that the delivery feed tapes 12B will deliver mail to sorting conveyor 24 while leaf 18, being present and extended, will deliver mail to its sorting conveyor 22.

The delivery leaves or auxiliary extensions 18 and 20, FIG. 3, embody endless delivery tapes as 82 supported on a frame 84, FIG. 1, in turn supported in a cantilever relationship at one end of the main frame 86 of the machine. The tapes 82 may be driven in any preferred manner, taking up where the tapes 10B and 12B end as shown in FIG. 2.

The leaves 18 and 20 are secured in position by respective pins 88 and 89, such that by pulling a pin the leaf may be detached. Each such pin is passed through the pulley or rollers as 92 which support the tapes 82. It will be noted from FIG. 1 that the cantilever relation for leaves 18 and 20 is maintained simply by nesting a right angle corner of frame 84 against a corresponding corner at the opposed end of frame 86.

OPERATION

The machine is cyclically driven, drive shaft 46 affording a constant feed drive for the delivery conveyor, the labeling heads and the scanning heads, the latter being synchronized to the delivery tapes.

Ordinarily the variable speed motors as 72 will be operating at a slow speed and this speed will prevail as long as the mail fed thereto has labels complying with a common zip code.

It may be assumed that the sorting conveyor 28 is the only one of the two that is active, an attendant may stand strategically on the left hand side of this sorting conveyor as viewed in FIG. 2, in position to supervise both conveyors.

As long as the scanner head, say 38A, detects continuity in the zip code numbers the mail will continue to be delivered to the sorting conveyor 24 in a constant stream, with appropriate batch count separations, on belt 28. If, however, a change in zip code is sensed at the scanning head 38A the information is stored until that cycle of the machine where the offending mail is at the threshhold of delivery to conveyor belt 28. The stored signal is then operative to control the rectifier of the variable speed motor or conveyor 24 which is instantly accellerated for one book cycle, leaving an obvious gap between the offender (the start of a new zip code series) and the trailing piece of mail last delivered to conveyor belt 28. The attendant is thereby alerted to the change.

For large pieces of mail in the single stream mode, the central divider 14 is removed. One or the other scanner and labeler (preferably 32) will then be used. Both leaves 18 and 20 will be extended, delivering to sorter belt 26. If desired, a scanner may be positioned in front of each labeler to stop the labeler if a book is missing.

We claim:

1. In a mailing sorter, a pair of parallel delivery conveyors each to be driven at a substantially constant speed for moving mail as separate pieces in a forward stream past a label applying means, a pair of parallel sorting conveyors proximate to one end of each delivery conveyor in position to receive the pieces of mail therefrom and move the mail along a path for mail separation, said sorting conveyors extending substantially at right angles to the delivery conveyors, the end of each delivery conveyor proximate the related sorting conveyor having a selectively extendable conveyor leaf thereon which when extended delivers mail in the related stream to one sorting conveyor whilst when detached mail in said related stream is delivered to the other sorting conveyor, label applying means for applying to the mail on the delivery conveyors labels which bear data identifying an order of mail, change speed motor means for driving each sorting conveyor normally at one speed as mail pieces of one order continue to be delivered thereto by the related delivery conveyor and to momentarily drive the sorting conveyor at an appreciably higher speed when there is a change in the order of mail pieces thereby to establish an obvious sorting gap between the trailing end of the one order of mail and the leading end of the next order of mail on the related sorting conveyor, scanning means to sense said data and generate a signal indicative of a change in the order of the mail, and control means responsive to such a signal to change the speed of the motor to sort the mail.

2. A sorter according to claim 1 wherein the drive to the sorting conveyor includes a clutch, a sensor to detect any interruption in the stream of mail and thereupon to generate a signal, and control means operated by such a signal to disengage the clutch.

3. A method of sorting mail comprising the steps of: operating a delivery conveyor to feed pieces of mail in a stream at a substantially constant speed past a labeler which applies to the mail labels bearing data identifying an order of mail, scanning data associated with the labels to detect a change in the order of mail presented by such data, delivering the pieces of mail one by one to a sorting conveyor normally driven at a slow speed, accelerating said sorting conveyor momentarily to establish a gap between pieces of mail on the sorting conveyor thereby to separate mail of different order in response to detection of a change in the order of mail, scanning the pieces of mail on the delivery conveyor to determine any discontinuity in the stream of mail, and momentarily stopping the sorting conveyor when a discontinuity is detected thereby to avoid a false gap.

4. A method according to claim 3 including the step of arranging the sorting conveyor path substantially at right angles to the path of the delivery conveyor, easily to service both conveyors.

* * * * *